United States Patent [19]

Greer et al.

[11] Patent Number: 5,002,235

[45] Date of Patent: Mar. 26, 1991

[54] ROLL LIFT AND DRIVE ASSEMBLY

[75] Inventors: Larry J. Greer, Chesterfield, Mo.; Kim A. Lerch, Waterloo, Ill.

[73] Assignee: Allied Gear and Machine Co. Inc., St. Louis, Mo.

[21] Appl. No.: 267,819

[22] Filed: Nov. 7, 1988

[51] Int. Cl.[5] ..... B65H 16/04; B66F 11/00

[52] U.S. Cl. ..... 242/58.6; 242/79; 414/745.9; 414/911

[58] Field of Search ..... 242/35.5 A, 58.6, 79; 414/911, 745.9, 746.4; 248/251, 264; 211/105.3, 105.1

[56] References Cited

U.S. PATENT DOCUMENTS

| | | | |
|---|---|---|---|
| 562,233 | 6/1896 | Miller | 248/251 |
| 937,376 | 10/1904 | Masden | 211/105.3 |
| 2,193,765 | 3/1940 | Krengel | 242/79 |
| 2,268,887 | 1/1942 | Matteson | 242/79 |
| 2,503,995 | 4/1950 | Bouget | 242/58.6 X |
| 2,561,543 | 7/1951 | Teplitz | 242/79 |
| 2,594,656 | 4/1952 | Junkunc | 248/264 X |
| 2,650,771 | 9/1953 | Marion | 242/58.6 X |
| 3,098,621 | 7/1963 | Nelson et al. | 242/79 |
| 3,329,369 | 7/1967 | Guthrie | 242/79 |
| 3,374,686 | 3/1968 | Brewer | 474/135 |
| 3,690,583 | 9/1972 | Herman | 242/79 X |
| 4,239,165 | 12/1980 | Weiss | 242/58.6 |
| 4,358,143 | 11/1982 | Cullen | 242/41 X |
| 4,462,749 | 7/1984 | Crocker et al. | 414/745.9 |
| 4,593,883 | 6/1986 | Nelson | 414/911 X |
| 4,728,248 | 3/1988 | Martins | 414/911 X |

FOREIGN PATENT DOCUMENTS

| | | | |
|---|---|---|---|
| 157159 | 7/1987 | Japan | 242/54 R |

*Primary Examiner*—Daniel P. Stodola
*Assistant Examiner*—Paul T. Bowen
*Attorney, Agent, or Firm*—Cohn, Powell & Hind

[57] ABSTRACT

A printing press material roll lift and drive assembly (40) has a base (16) and a lift support frame (18). The lift support frame provides support for opposed front and rear vertical rails (50). A U-shaped carriage (54) is mounted for elevation on the rails and includes side support plates (56) having rail rollers (57) and an upper plate (58). The carriage is raised and lowered by a releasing ram (80) attached to the support frame at its upper end (82) and to the carriage at its lower end (86), said support plates including bearings receiving a carriage shaft (64). The shaft includes a cantilevered outer end (68) receiving the paper roll core (69) and an inner end (72). The inner end is driven by a magnetic particle clutch (102) mounted to the base and having a drive shaft (106) by means of an endless belt (112) extending between a drive shaft pulley (110) and a carriage shaft pulley (74). The endless belt includes a belt tensioner (114). The horizontal distance between the motor drive shaft and the carriage drive shaft is constant while the vertical distance between said shaft is variable and the belt tensioner provides that the paper roll (14) can be raised and lowered without otherwise requiring adjustment of the endless belt. A cradle assembly (130) is provided having a ramp member (154) and a roller track (150) for facilitating positioning the roll for acceptance on the carriage shaft. An outboard support arm (174) is provided to receive the carriage shaft end (168) when required, said arm being swung into a stored position when not required.

12 Claims, 3 Drawing Sheets

FIG. 1.

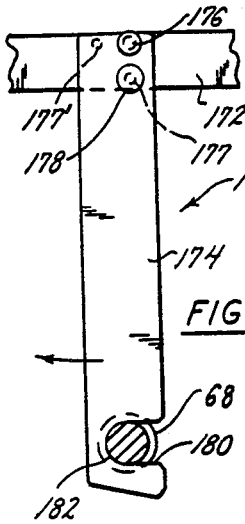
FIG. 7.
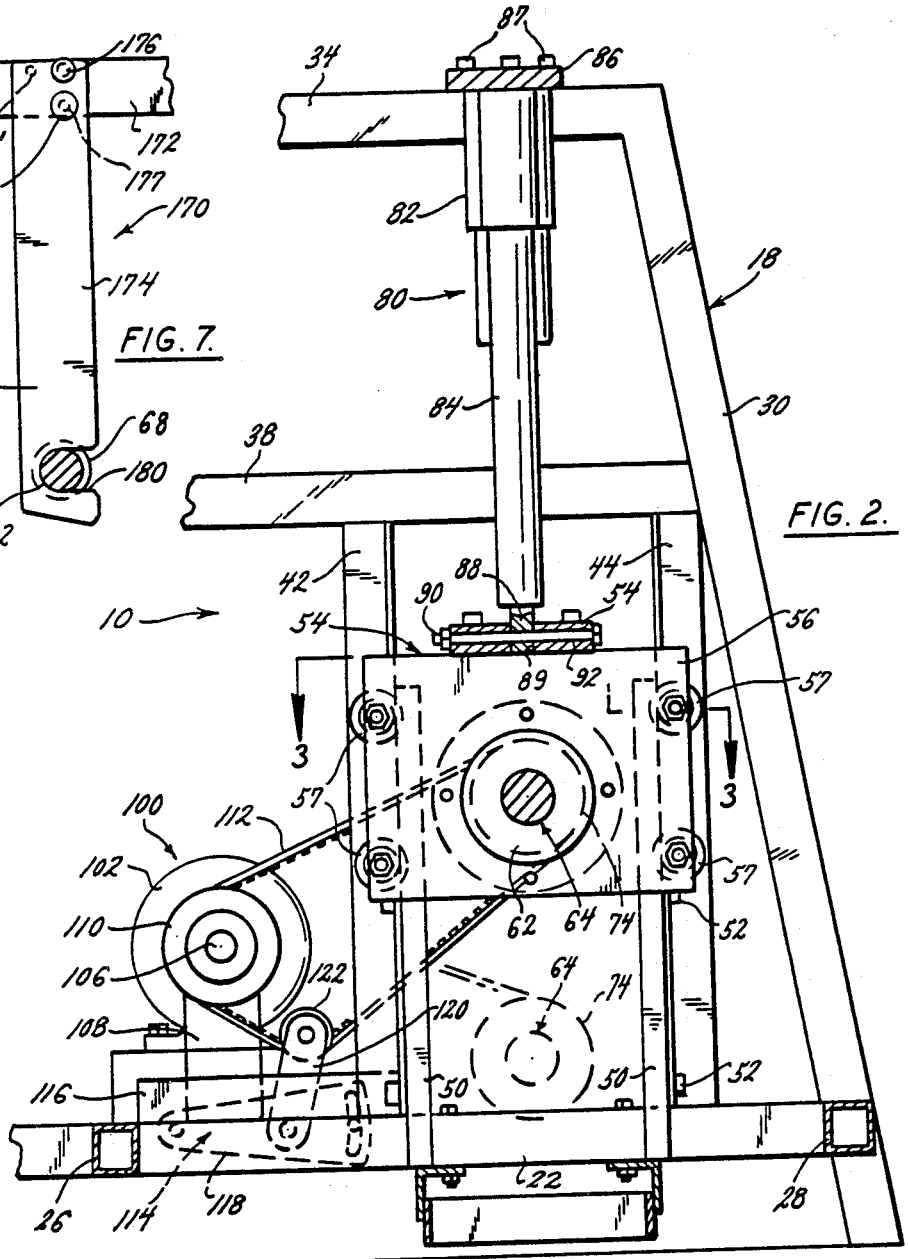
FIG. 2.
FIG. 3.
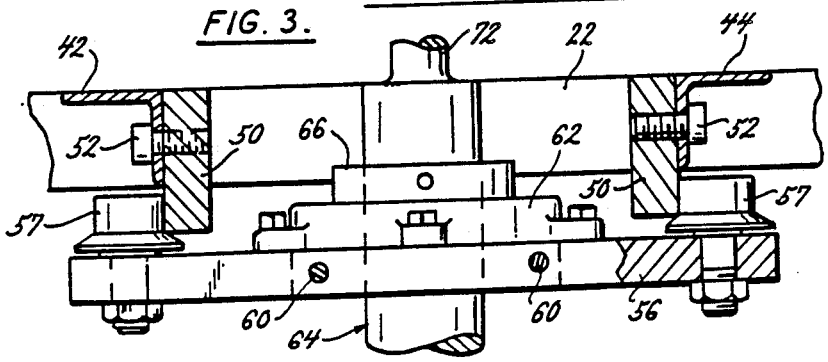

ROLL LIFT AND DRIVE ASSEMBLY

BACKGROUND OF THE INVENTION

This invention relates generally to a material roll support assembly and particularly to a drive and lift assembly which permits the roll to be loaded onto the support shaft and elevated while maintaining engagement of the drive assembly.

In the operation of printing presses it is necessary to load and unload rolls of web forming material. Small, lightweight rolls present no problem and are usually handled manually. Large, heavy rolls, however, require mechanical handling to avoid damage to the product or injury to the operator.

Various solutions have been tried in the handling of large rolls. In the case of presses of the type having a removable core shaft, for example, somewhat complicated pivoted yokes have been used that engage the shafted roll to raise it into operating position. In the case of presses having a cantilevered core shaft independent auxiliary lift means have been used to raise the roll. Vertical lift carriages are also known which raise the roll to the cantilever core shaft level and rely on the operator to jostle the roll onto the core shaft. It is also common to provide specially equipped fork lift trucks to raise the roll.

The removable shaft type of device tends to be expensive and the cantilevered type of device invariably presents alignment problems even when outboard support is provided.

The present invention solves these and other problems in a manner not revealed in the known prior art.

SUMMARY OF THE INVENTION

This lift and drive assembly for a printing press material roll which permits loading of the roll at a low level and raising the roll to an operating level without requiring disengagement of the drive system.

The roll shaft is mounted for vertical travel and driven by an endless belt which returns to a preset tension when the shaft returns to its operating position.

A cradle assembly is provided which includes a ramp and roller system. The ramp permits the roll to be easily pushed onto the rollers in alignment with the core shaft and the rollers facilitate the pushing of the roll onto the shaft. The cradle assembly is retractable for storage.

An outboard support is provided for the roll shaft which is used for rolls over a predetermined weight but which can be swung away during loading and unloading or when lightweight rolls are used.

It is an aspect of this invention to provide a roll lift and drive assembly including support means including base means and opposed rail means eXtending upwardly from the base means; carriage means mounted to the rail means for elevational movement and including a shaft having opposed ends, one of said ends extending outwardly of the carriage means in cantilever relation to receive a paper roll; actuating means for moving the carriage means on the rail means, and drive means mounted to the base means and including a drive shaft, an endless element interconnecting the drive shaft to the other end of said carriage shaft and belt tensioning means maintaining tension in the endless element during elevational movement of the axis of the carriage shaft relative to the axis of the drive shaft.

It is another aspect of this invention to provide that said support means includes an upper support portion disposed above the carriage means, and said actuating means includes a ram interconnected between said carriage means and said support means.

It is still another aspect of this invention to provide that the carriage means includes an outer side member, an inner side member and an upper member connected between said side members, and said actuating means is connected to said carriage means in offset relation to balance the weight of the paper roll.

It is yet another aspect of this invention to provide that the axis of rotation of the drive shaft and the carriage shaft are substantially parallel, the horizontal distance between said axes of rotation being fixed and the vertical distance between said axes of rotation being variable.

An aspect of this invention is to provide that the drive shaft includes a drive pulley and the carriage shaft includes a driven pulley and said endless element is an endless belt interconnecting said pulleys, said drive shaft and said carriage shaft being on opposite sides of the plane of the endless belts.

Another aspect of this invention is to provide that the tensioning means includes a belt tensioner having a base member attached to the base means and a spring biased arm member pivotally attached to the base member and having a rotatable member at the end thereof engageable with said endless belt.

Still another aspect of this invention is to provide cradle means below the carriage shaft cantilever end, said cradle means including roller means for moving the roll axially onto the shaft and ramp means at one side of the roller means for positioning the roll on the roller means.

Yet another aspect of this invention is to provide that the cradle means includes an inclined stop means on the other side of the roller means, and another aspect to provide that the stop means is hinged for swinging away from the ramp means.

In another aspect of this invention the base means includes guide means for receiving the cradle means, at least in part, in retractible, stored relation beneath the base means.

In still another aspect of this invention the guide means includes opposed guide members, and the cradle means includes a wheeled rearward portion having opposed members received in guided relation between the guide members, and a forward portion having a base plate carrying the roller means and the ramp means.

It is yet another aspect of this invention to provide outboard support means for the carriage shaft, said support means having an upper end attached to the upper support portion in swingaway relation and a lower end selectively receiving the carriage shaft in rotatable relation.

It is an aspect of this invention to provide a printing press material roll lift and drive assembly which is relatively easy and inexpensive to manufacture, simple to install and effective in operation.

BRIEF DESCRIPTION OF THE DRAWINGS

FIG. 2 is an enlarged cross sectional view taken on line 2—2 of FIG. 1 showing two positions of the drive assembly;

FIG. 3 is a fragmentary sectional plan view taken on line 3—3 of FIG. 2;

FIG. 7 is an elevational view of the roll shaft outboard support arm taken on line 7—7 of FIG. 1.

DESCRIPTION OF THE PREFERRED EMBODIMENT

Figures 1, 4:
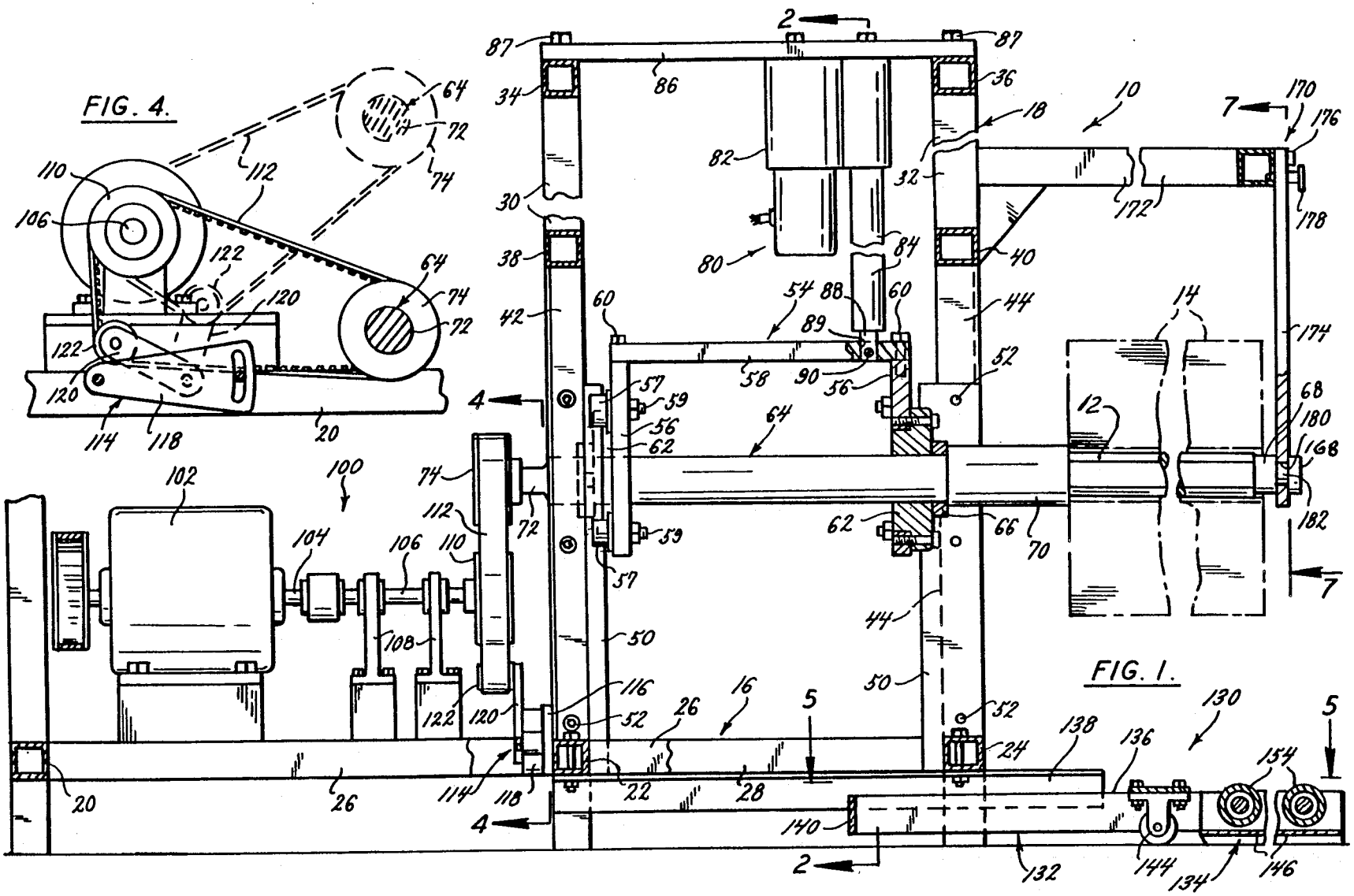
FIG. 1 is a cross sectional view showing the lift and drive assembly.
FIG. 4 is a fragmentary cross sectional view taken on line 4—4 of FIG. 1.

Referring now by reference numerals to the drawings and first to FIG. 1 it will be understood that the lift and drive assembly 10 provides a means of elevating and supporting a shaft for a material roll 14.

The assembly 10 includes a structural support means formed generally from rectangular tubular members welded together to provide a base 16 and a lift support frame 18. The base 16 is formed from longitudinal members 20, 22 and 24 and cross members 26 and 28 The lift support frame 18 includes inclined opposed rear members 30 and 32, upper headers 34 and 36 and intermediate headers 38 and 40. The lift support frame 18 also includes opposed front rail posts 42 and rear rail posts 44. Rail posts 42 and 44 are connected between base member 22 and header 38 and between base member 24 and header 40 respectively and have rail plates 50 attached thereto as by fasteners 52.

A carriage generally indicated by 54, is mounted for elevation movement on the rails 50. The carriage 54 is generally U-shaped and includes opposed side plates 56 and an upper plate 58 connected therebetween as by bolts 60. The side plates 56 are each provided with four (4) flanged rollers 57 attached thereto by bolts 59 and engageable with rails 50 in rolling relation and the side plates are apertured to receive journal bearings 62 bolted thereto. The bearings receive a carriage shaft 64 which is held in place by collars 66. The shaft 64 includes an outer end 68 which extends outwardly of said carriage 54 in cantilever relation to receive the expandable core 12 of the roll 14 of material such as paper which is spaced from its associated collar 66 by a sleeve 70. The shaft inner end 72 is reduced in size to receive a pulley 74 fixedly attached thereto. The carriage 54, and therefore the shaft 64, are raised and lowered by an actuator which, in the preferred embodiment, is a commercially available electrically operated ram 80 such as the power screw sold by Warner Electric Corporation of South Beloit, Ill. under the name of Electrak Linear Actuator, Model No. A12-05B5-121. The ram 80 includes an upper portion 82 and a lower portion in the form of a telescopic member 84. The upper portion 82 is attached, as by bolts, to crossbar 86 spanning between said frame headers 34 and 36. The cross bar 86 is fixedly attached to said headers by bolts 87 so that it effectively forms part of the lift frame 18. The telescopic member 84 is apertured at its reduced diameter lower end 88 and is received by a vertical opening 89 provided in the carriage upper plate 58. The member 84 is attached to said carriage plate by a fastener 90, which passes through a transverse passage 92 provided in said plate 58 and through said piston lower end 88. It will be particularly observed that the connection of the ram 80 to the carriage 54 is offset from the carriage center line which tends to compensate for the cantilevered load on the shaft 64 received from the roll 14. Also the flanged rollers 57 tend to preclude canting of the carriage 54.

The carriage shaft 64 and the outboard paper roll 14 are rotated by a drive means 100 which includes an electric motor (not shown) which drives a magnetic particle clutch 102 which is mounted to the base 16, and includes a drive shaft 104, having an extension shaft 106 supported by bearings 108, also attached to said base 16, and carrying a drive pulley 110 at the outer end. The drive means also includes an endless drive element in the form of a belt 112 interconnecting the drive pulley 110 and the carriage shaft pulley 74. Importantly, and as best shown in FIGS. 2 and 4, the drive means also includes a belt tensioning means 114 mounted to a mounting plate 116 which is welded, or otherwise securely attached, to the longitudinal frame member 22. It will be understood that the horizontal distance between the axes of rotation of the carriage shaft 64 and the drive shaft 106 is constant. However, the vertical distance between said axes of rotation varies depending on the elevation of the carriage shaft 64 as shown in FIG. 2 in which the upper position is shown in full and said lower portion is shown in phantom outline; the reverse positions being shown in FIG. 4. The belt tensioner means 114 provides that the belt 112 remains taut in both the upper and lower shaft positions and in all position therebetween. This arrangement permits the raising and lowering of the shaft 64 without further adjustment of the belt 112 and also provides that said belt returns to its preset tension when shaft 64 is returned to the upper operating position. In the embodiment shown, the belt tensioning means 114 is provided by a belt tension manufactured by Brewer Machine and Gear Co. of St. Louis, Mo. under the designation TM44 and disclosed in U.S. Pat. No. 3,374,686. This belt tensioner includes a base member 118 attached to the mounting plate 116 and having a spring-biased arm 120 carrying an idler pulley 122 which is engageable with the inside face of the belt 112.

Figure 5:
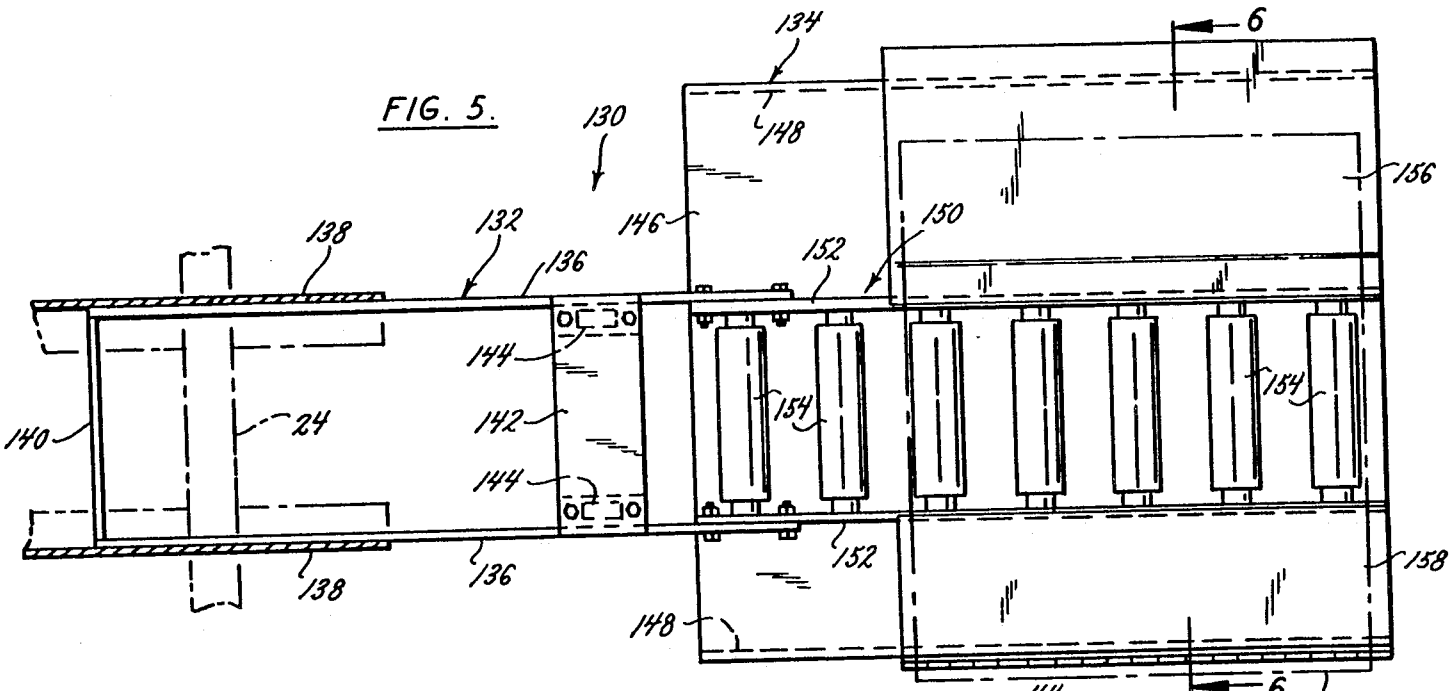
FIG. 5 is a plan view of the roll-receiving cradle.
Figure 6:
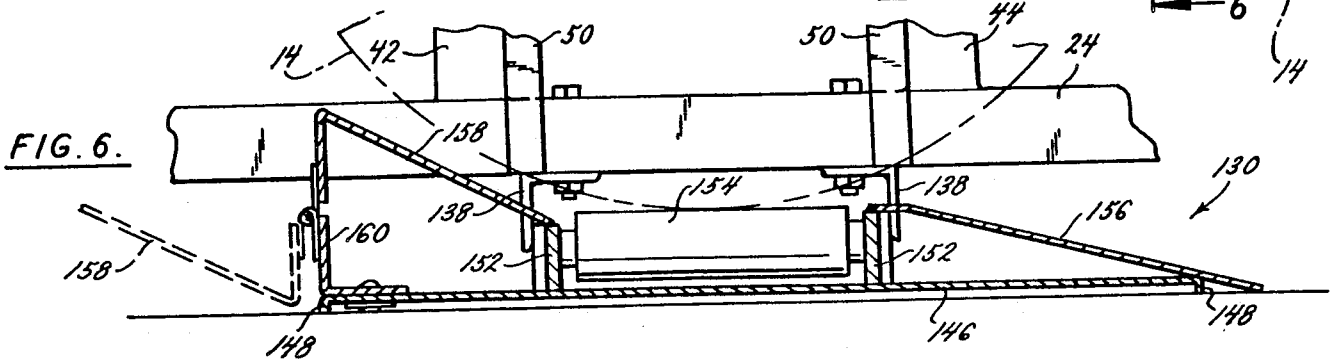
FIG. 6 is an enlarged cross sectional view taken on line 6—6 of FIG. 5.

As shown in FIG. 1, and in greater detail in FIGS. 5 and 6, a cradle assembly generally indicated by numeral 130 is provided to position and align the roll 14 for acceptance onto the outer end 68 of the carriage shaft 64. The cradle 130 includes a U-shaped rearward portion 132 and a forward portion 134. The rearward portion 132 includes a pair of side members 136 received in retractible relation between opposed guide angles 138, bolted to base members 22 and 24, end member 140, and a crossbar 142 having a pair of wheels 144 attached thereto. The forward portion 134 includes a base plate 146 having downturned edges 148, and a roller track 150. The roller track 150 includes side members 152, welded or otherwise attached to the base plate 146, and having a plurality of rollers 154 rotatably mounted therebetween. The side members 152 are bolted to associated side members 136. As best shown in FIG. 6 the cradle forward portion 134 also includes a ramp member 156 at one side which is attached, as by welding, between a side 152 and the base plate edge 148. An inclined stop member 158 is provided at the other side of the cradle forward portion 134 which is hingedly attached to a longitudinal side member 160 fixedly attached to the base plate 146. This hinged arrangement provides that the stop member 158 acts as a stop for rolls 14 but can be swung out of the way when large diameter rolls are used. The roll 14 can be easily rolled up the ramp member 156 and positioned on the roller track 150 in alignment with the carriage shaft longitudinal axis so that it can be pushed toward and onto the carriage shaft outer end 68. When not in use the cradle assembly 130 can be stored by lifting the front end and pushing rearwardly so that the assembly wheels under the base 16 until the rearward edge of ramp member 150 engages the guide angles 138.

As shown in FIGS. 1 and 7 an outboard support 170 is provided for the carriage shaft 64 when a heavy roll 14 is used. The outboard support 170 includes an outwardly extending bracket 172, forming part of the upper support portion 18, and a depending arm 174. The arm 174 is attached at its upper end to bracket 172 by means of a pivot pin 176 and a spring-loaded plunger pin 178 spaced from said pivot pin and receivable within an opening 177 provided in said bracket. At its lower end the arm 174 includes a slot 180 which receives the carriage shaft end 168 in rotational relation, said shaft end being provided with an annular groove 182 received by said slot. The double pin connection provided at the upper end of the arm 174 by the spaced pins 176 and 178 provide a support couple which resists swinging movement of said arm. When it is desired to store the arm 174 during roll replacement or when a lightweight roll is being used, it is simple a matter of releasing the plunger pin 178 and swinging the arm 174 upwardly into a horizontal position in which it is held by a second opening 177' receiving said plunger pin 178.

When it is desired to remove and replace a roll 14, the ram 82 is actuated to lower the carriage shaft 64 from its upper position shown in FIG. 1 to its lower position shown in FIG. 4 until the weight is taken by the cradle roller track 150. In the lower position the roll 14 can readily be slid outwardly off the carriage shaft 64 and rolled down the ramp member 156. It is a simple matter to roll a new roll 14 up the ramp, raise the carriage shaft 64 to an appropriate elevation to receive it and push it onto said shaft. It is then also a simple matter of actuating the ram 82 to raise the carriage shaft 64 until the new roll is in its operational position. If the new roll is sufficiently heavy the outboard support 170 is used.

In view of the above it will be understood that various aspects and features of the invention are achieved and other advantageous results are attained. While a preferred embodiment of the invention has been shown and described, it will be clear to those skilled in the art that various modifications may be made without departure from the invention in its broader aspects.

We claim as our invention:

1. A roll lift and drive assembly comprising:

(a) support means including base means and opposed stationary rail means extending upwardly from the base means and fixedly connected to the base means, (b) carriage means mounted to the stationary rail means for elevational movement and including a single carriage shaft having opposed ends, one of said ends extending outwardly of the carriage means in cantilever relation to receive a roll and provide easy access and support for said roll and the other of said ends being drive-connectible.

(c) actuating means for moving the carriage means on the rail means, and (d) drive means mounted to the base means and rotating the carriage shaft at a selected elevation, the drive means including a drive shaft, an endless element interconnecting the drive shaft to the other end of said carriage shaft, opposite the roll-receiving end, and endless element tensioning means maintaining tension in the endless element during elevational movement of the axis of the carriage shaft relative to the axis of the drive shaft so that the endless element remains taut during elevation of the carriage shaft and provides operating tension when the roll is in its operating position.

2. A lift and drive assembly as defined in claim 1, in which:

(e) said support means includes a stationary upper support portion disposed above the carriage means, and (f) said actuating means includes a ram interconnected between said carriage means and said support portion.

3. A lift and drive assembly as defined in claim 2, in which:

(g) the carriage means includes an outer side member, an inner side member and an upper member connected between said side members, and (h) said ram is connected to said carriage means in offset relation to balance the weight of the paper roll.

4. A lift and drive assembly as defined in claim 1, in which:

(e) the axis of rotation of the drive shaft and the carriage shaft are substantially parallel, the horizontal distance between said axes of rotation being fixed and the vertical distance between said axes of rotation being variable.

5. A lift and drive assembly as defined in claim 4, in which:

(f) the drive shaft includes a drive pulley and the carriage shaft includes a driven pulley and said endless element is an endless belt interconnecting said pulleys and defining a plane having opposite sides, said drive shaft and said carriage shaft being on opposite sides of the plane defined by the endless belt.

6. A lift and drive assembly as defined in claim 5, in which:

(g) the drive means includes a belt tensioner having a base member attached to the base means and a spring biased arm member pivotally attached to the base member and having a rotatable member at the end thereof engageable with said endless belt.

7. A lift and drive assembly as defined in claim 1, in which:

(e) cradle means below the carriage shaft cantilever end, said cradle means including roller means for moving the roll axially onto the carriage shaft and ramp means at one side of the roller means for positioning the roll on the roller means.

8. A lift and drive assembly as defined in claim 7, in which:

(f) the cradle means includes an inclined stop means on the other side of the roller means opposite the ramp means.

9. A lift and drive assembly as defined in claim 1, in which:

(e) said support means includes an upper support portion, and (f) outboard support means is provided for the carriage shaft, said support means having an upper end attached to the upper support portion in swingaway relation and a lower end selectively receiving and supporting the carriage shaft in rotatable relation.

10. A roll lift and drive assembly comprising:

(a) support means including base means and opposed rail means extending upwardly from the base means, (b) carriage means mounted to the rail means for elevational movement and including a carriage shaft having opposed ends, one of said ends extending outwardly of the carriage means in cantilever relation to receive a paper roll, (c) actuating means for moving the carriage means on the rail means, (d) drive means mounted to the base means and including a drive shaft, an endless element interconnecting the drive shaft to the other end of said carriage shaft, opposite said roll-receiving end, and endless element tensioning means maintaining tension in the endless element during elevational movement of the axis of the carriage shaft relative to the axis of the drive shaft, (e) cradle means below the carriage shaft cantilever end, said cradle means including roller means for moving the roll axially onto the carriage shaft and ramp means at one side of the roller means for positioning the roll on the roller means, (f) the cradle means including an inclined stop means opposite the ramp means, and (g) the inclined stop means being hingedly attached to swing away from the ramp means.

11. A roll lift and drive assembly comprising:

(a) support means including base means and opposed rail means extending upwardly from the base means, (b) carriage means mounted to the rail means for elevational movement and including a carriage shaft having opposed ends, one of said ends extending outwardly of the carriage means in cantilever relation to receive a paper roll, (c) actuating means for moving the carriage means on the rail means, (d) drive means mounted to the base means and including a drive shaft, an endless element interconnecting the drive shaft to the other end of said carriage shaft, opposite said roll-receiving end, and endless element tensioning means maintaining tension in the endless element during elevational movement of the axis of the carriage shaft relative to the axis of the drive shaft, (e) cradle means below the carriage shaft cantilever end, said cradle means including roller means for moving the roll axially onto the carriage shaft and ramp means at one side of the roller means for positioning the roll on the roller means, and (f) the base means including guide means for receiving the cradle means, at least on part, in retractible, stored relation beneath the base means.

12. A lift and drive assembly as defined in claim 1, in which:

(g) the guide means includes opposed guide members, and (h) the cradle means includes a wheeled rearward portion having opposed members received in guided relation between the guide members, and a forward portion having a base plate carrying the roller means and the ramp means.

* * * * *